US007128309B2

(12) United States Patent
Edamatsu et al.

(10) Patent No.: US 7,128,309 B2
(45) Date of Patent: Oct. 31, 2006

(54) AUTOMATIC CHOKE SYSTEM FOR CARBURETOR

(75) Inventors: Shigeki Edamatsu, Saitama (JP); Hiroshi Moriyama, Saitama (JP); Takashi Suzuki, Saitama (JP); Takanori Sato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/185,019

(22) Filed: Jul. 20, 2005

(65) Prior Publication Data

US 2006/0022359 A1 Feb. 2, 2006

(30) Foreign Application Priority Data

| | | |
|---|---|---|
| Jul. 26, 2004 | (JP) | 2004-216996 |
| Jul. 26, 2004 | (JP) | 2004-216997 |
| Jul. 26, 2004 | (JP) | 2004-216998 |
| Jul. 26, 2004 | (JP) | 2004-216999 |
| Jul. 26, 2004 | (JP) | 2004-217000 |
| Aug. 18, 2004 | (JP) | 2004-238748 |

(51) Int. Cl.
*F02M 1/10* (2006.01)

(52) U.S. Cl. ..... 261/39.1; 123/179.18; 261/39.2

(58) Field of Classification Search ..... 261/39.1–39.6; 123/179.18
See application file for complete search history.

(56) References Cited

U.S. PATENT DOCUMENTS

| | | | | |
|---|---|---|---|---|
| 4,662,333 | A * | 5/1987 | Martel | 123/339.13 |
| 4,788,014 | A * | 11/1988 | Kanno | 261/39.2 |
| 4,984,542 | A * | 1/1991 | Rische et al. | 123/339.1 |
| 5,378,411 | A * | 1/1995 | Iwaki et al. | 261/39.2 |
| 5,511,519 | A * | 4/1996 | Watson et al. | 123/179.18 |
| 5,537,964 | A * | 7/1996 | Hoshiba | 123/179.18 |
| 5,711,901 | A * | 1/1998 | Berg et al. | 261/35 |
| 5,803,035 | A * | 9/1998 | Guntly | 123/179.11 |
| 6,003,845 | A * | 12/1999 | Kus | 261/39.4 |
| 6,012,420 | A * | 1/2000 | Dykstra et al. | 123/179.18 |
| 6,145,487 | A * | 11/2000 | Dykstra et al. | 123/179.18 |
| 6,508,217 | B1 * | 1/2003 | Aodai et al. | 123/179.13 |
| 6,581,567 | B1 * | 6/2003 | Deguchi | 123/336 |
| 6,901,919 | B1 * | 6/2005 | Namari et al. | 123/588 |

(Continued)

FOREIGN PATENT DOCUMENTS

| | | |
|---|---|---|
| JP | 57-182241 | 11/1982 |

(Continued)

*Primary Examiner*—Richard L. Chiesa
(74) *Attorney, Agent, or Firm*—Arent Fox PLLC

(57) ABSTRACT

An automatic choke system includes: a wax-type temperature sensing section; and an output section which opens a choke valve of a carburetor in response to heat receiving operation of the temperature sensing section. Temperature sensing section includes: a bottomed cylindrical housing attached to an engine with its bottom portion directed to a high-temperature portion of the engine; a bottomed movable cylinder; a stationary piston slidably supported by the movable cylinder and having one end protruding out of the movable cylinder; and a wax contained in the movable cylinder in a sealed manner, and causing the movable cylinder and the stationary piston to move relative to each other in an axial direction. The movable cylinder is slidably housed in the housing in a state in which an outer end of the stationary piston abuts against an inner surface of the bottom portion of the housing. The output section is connected to the movable cylinder. Thus, the rate of opening of the choke valve can be increased immediately after the start of engine warming-up operation, and reduced as approaching the completion of engine warming-up operation.

10 Claims, 16 Drawing Sheets

U.S. PATENT DOCUMENTS

| | | | | |
|---|---|---|---|---|
| 6,941,916 | B1 * | 9/2005 | Sigerud et al. | 123/179.15 |
| 6,990,969 | B1 * | 1/2006 | Roth et al. | 123/676 |
| 2005/0087173 | A1 * | 4/2005 | Sigerud et al. | 123/442 |
| 2006/0022359 | A1 * | 2/2006 | Edamatsu et al. | 261/39.1 |

FOREIGN PATENT DOCUMENTS

| | | | | |
|---|---|---|---|---|
| JP | 4-17762 | * | 1/1992 | 261/39.3 |

* cited by examiner

AUTOMATIC CHOKE SYSTEM FOR CARBURETOR

RELATED APPLICATION DATA

The Japanese priority application Nos. 2004-216996, 2004-216997, 2004-216998, 2004-216999, 2004-217000 and 2004-238748 upon which the present application is based are hereby incorporated in their entirety herein by reference.

BACKGROUND OF THE INVENTION

1. Field of the Invention

The present invention relates to an improvement in an automatic choke system for a carburetor, comprising: a wax-type temperature sensing section attached to an engine; and an output section providing a connection between the temperature sensing section and a choke valve of the carburetor, and operated to open the choke valve in response to heat receiving operation of the temperature sensing section.

2. Description of the Related Art

Such an automatic choke system for a carburetor is known, for example, as disclosed in Japanese Utility Model Laid-Open No. 57-182241.

In the conventional automatic choke system for a carburetor, a wax-type temperature sensing section has a cylinder, a piston slidably supported in the cylinder and having one end projecting out of the cylinder, wax contained in the movable cylinder and causing the movable cylinder and the stationary piston to move relative to each other in the axial direction when it is thermally expanded, and a return spring urging the movable cylinder and the stationary piston in the direction to compress the wax. The cylinder is mounted on the engine with the wax facing a high-temperature portion of the engine, and the piston is connected to the output section. In this automatic choke system, the wax is always exposed to the high-temperature portion of the engine, so that the rate at which heat is received from the engine is constant, and thus the rate of opening the choke valve is also constant with the progress of engine warming-up operation.

However, in order to appropriately perform the engine warming-up operation, it is required to increase the rate of opening the choke valve immediately after a start of engine warming-up operation and to decrease it as approaching the completion of warming-up operation.

SUMMARY OF THE INVENTION

The present invention has been achieved in view of the above-mentioned circumstances, and has an object to provide an automatic choke system for a carburetor capable of changing the rate of opening the choke valve in the above-described manner.

In order to achieve the above-mentioned object, according to a first feature of the present invention, there is provided an automatic choke system for a carburetor, comprising: a wax-type temperature sensing section attached to an engine; and an output section providing a connection between the temperature sensing section and a choke valve of the carburetor, and operated to open the choke valve in response to heat receiving operation of the temperature sensing section, wherein the temperature sensing section includes: a bottomed cylindrical housing attached to the engine with its bottom portion directed to a high-temperature side; a bottomed movable cylinder; a stationary piston slidably supported in the movable cylinder and having one end protruding out of the movable cylinder; a wax contained in the movable cylinder in a sealed manner, and causing the movable cylinder and the stationary piston to move relative to each other in an axial direction; and a return spring urging the movable cylinder and the stationary piston in a direction to compress the wax, the movable cylinder being slidably housed in the housing in a state in which an outer end of the stationary piston abuts against an inner surface of the bottom portion of the housing, the output section being connected to the movable cylinder.

With the first feature of the present invention, the stationary piston in the housing of the temperature sensing portion is in contact with the inner surface of the bottom portion where the amount of heat received from the engine during the operation of engine is the largest, and the movable cylinder containing the wax moves away from the bottom portion in the housing in response to thermal expansion of the wax. Therefore, the amount of heat received from the housing by the wax in the movable cylinder is large immediately after a start of engine warming-up operation, and is decreasing with the progress of engine warming-up operation. As a result, opening of the choke valve is accelerated immediately after the start of engine warming-up operation to effectively suppress an excessively large concentration of fuel in the air-fuel mixture; and as approaching the completion of warming-up operation, the rate of opening the choke valve is decreasing. Therefore, the warming-up operation can be stably continued. Further, excessive thermal degradation of the wax can be prevented after the completion of warming-up operation, i.e., after fully opening the choke valve.

According to a second feature of the present invention, there is provided an automatic choke system for a carburetor, comprising: a wax-type temperature sensing section attached to an engine; and an output section providing a connection between the temperature sensing section and a choke valve of the carburetor, and operated to open the choke valve in response to heat receiving operation of the temperature sensing section, wherein the temperature sensing section includes: a bottomed cylindrical housing attached to the engine; a bottomed movable cylinder; a stationary piston slidably supported in the movable cylinder and having one end protruding out of the movable cylinder; a wax contained in the movable cylinder in a sealed manner, and causing the movable cylinder and the stationary piston to move relative to each other in an axial direction; and a return spring urging the movable cylinder and the stationary piston in a direction to compress the wax, the movable cylinder being slidably housed in the housing in a state in which an outer end of the stationary piston abuts against an inner surface of a bottom portion of the housing, the output section being connected to the movable cylinder, the housing is constructed so that an amount of heat received by the wax is decreasing as the movable cylinder moves in a detection away from the bottom portion of the housing.

With the second feature of the present invention, the movable cylinder is moved away from the bottom portion in response to the thermal expansion of the wax with the progress of engine warming-up operation. Because the movable cylinder is moved in this way, the amount of heat received by the wax in the movable cylinder is decreasing. Therefore, the rate of opening the choke valve can be increased immediately after the start of engine warming-up operation, and decrease as approaching the completion of the engine warming-up operation, thus stabilizing the warming-up operation while avoiding an increase in the concentration of fuel in the air-fuel mixture. After the completion of engine warming-up operation, i.e., after fully opening the choke valve, the amount of heat received by the wax is further decreased, thus preventing an excessive thermal degradation of the wax.

According to a third feature of the present invention, in addition to the second feature, the housing comprises a cup-shaped first portion having a high heat conductivity and including the bottom portion, and a cylindrical second portion having a heat insulating property and connected to an open end of the first portion, and the movable cylinder moves from a side of the first portion to a side of the second portion in response to thermal expansion of the wax.

With the third feature of the present invention, heat is efficiently transmitted from the engine to the first portion of the housing having a high heat conductivity. Therefore, immediately after a start of engine warming-up operation in particular, the wax in the movable cylinder rapidly receives heat from the first portion and starts expanding to facilitate the opening of the choke valve, thus effectively suppressing an excessive concentration of fuel in the air-fuel mixture. The moveable cylinder is moved from the first portion to the second portion in the housing with the progress of engine warming-up operation, thereby effectively reducing the amount of heat received from the housing by the wax in the movable cylinder with the progress of warming-up operation. Thus, the rate of opening the choke valve can be appropriately reduced as approaching the completion of warming-up operation, thereby stably continue the warming-up operation. After completion of warming-up operation, the amount of heat received by the wax is further decreased, thus further contributing to prevention of an excessive head degradation of the wax.

According to a fourth feature of the present invention, in addition to the first or second feature, the housing comprises a first portion having a high heat conductivity and including the bottom portion, and a second portion having a heat insulating property and connected to the first portion on a side opposite from the bottom portion; and wherein the second portion is molded integrally with a heat-insulating member interposed between the engine and the carburetor.

With the fourth feature of the present invention, the housing of the temperature sensing section comprises: the first portion having a high heat conductivity and including the bottom portion; and a second portion having a heat insulating property and connected to the first portion on a side opposite from the bottom portion of the first portion. Therefore, heat generated in the engine is transmitted to the wax in the cylinder mainly through the first portion. Thus, the characteristics of the temperature sensing section can be changed by selecting the shape and position of the first portion only, whereby the choke system is applicable to various types of engine.

Moreover, since the first portion is formed integrally with the heat insulating portion interposed between the engine and the carburetor, the housing of the temperature sensing section can be supported on the engine without using any special supporting member, thus simplifying the structure and contributing to a reduction in cost of the automatic choke system.

According to a fifth feature of the present invention, in addition to the fourth feature, a bracket for supporting the output section is molded integrally with the heat-insulating member.

With the fifth feature of the present invention, the bracket supporting output section is also formed integrally with the heat insulating member. Therefore, the bracket can be supported on the engine without using any special supporting member, thus simplifying the structure and contributing to a further reduction in cost of the automatic choke system.

According to a sixth feature of the present invention, in addition to the first or second feature, the temperature sensing section is disposed in the vicinity of an intake port formed in a cylinder head of the engine.

With the sixth feature of the present invention, the peripheral portion of the intake port in the cylinder head is always cooled by intake air flowing through the intake port during engine operation. Therefore, a temperature characteristic corresponding to the progress of warming-up operation can be maintained without being affected by the fluctuation in the load on the engine. Therefore, the temperature sensing section placed near the intake port can appropriately operate in accordance with the progress of the warming-up operation irrespective of the fluctuation in the load on the engine. Thus, the opening of the choke valve can be always appropriately controlled, thereby contributing to an improvement in fuel consumption and emission characteristics of the engine.

According to a seventh feature of the present invention, in addition to the sixth feature, an accommodation chamber is formed by a peripheral wall of the intake port and a surrounding wall rising from one side of the peripheral wall, and the temperature sensing section is disposed in the accommodation chamber.

With the seventh feature of the present invention, the operating characteristic of the temperature sensing section with respect to the progress of warming-up of the engine can be regulated by selecting the length of the surrounding wall of the accommodation chamber so as to appropriately set the area of the inner surface of the accommodation chamber facing the temperature sensing section.

According to an eighth feature of the present invention, in addition to the first or second feature, the output section comprises: a first lever and a second lever which are pivotally supported via common axis in the bracket supported on the engine, the first lever being operated in response to the heat receiving operation of the temperature sensing section, the second lever being operated in association with the choke valve; abutting portions provided in the first and second levers so as to abut against each other while the abutting portions can move toward and away from each other; a connection spring connected to the abutting portions so that the abutting portions move in a direction to abut against each other; and before the choke valve is fully opened, the heat receiving operation of the temperature sensing section is transmitted from the first lever through the connection spring to the second lever in a direction to open the choke valve, and after the choke valve is fully opened, only the first lever is turned by the heat receiving operation of the temperature sensing section so that the abutting portions move away from each other against a set load of the connection spring.

With the eighth feature of the present invention, when the temperature sensing section further receives heat from the engine to cause an overstroke after the completion of engine warming-up operation at which the choke valve is fully opened, only the first lever is turned by the heat receiving operation of the temperature sensing section, so that the abutting portions are moved away from each other against the set load of the connection spring. Therefore, the overstroke action of the temperature sensing portion can be absorbed by deformation of the connection spring to avoid an excessive stress in components from the automatic choke system to the choke valve, thereby secure a good durability of the components. Moreover, since the first and second levers turnable relative to each other are mounted on the bracket via the common axis, the number of components in the output section can be reduced and the structure of the device can be simplified.

According to a ninth feature of the present invention, in addition to the first or second feature, a governor device is connected to a throttle valve of the carburetor so as to control the throttle valve to open when the engine is stopped and to close to a predetermined opening degree corresponding to a set rotational speed of the engine when the engine is running; and a choke forcibly-opening means is provided between the throttle valve and the choke valve to forcibly open the choke valve in association with the throttle valve closing from a fully opened position to an idling opening position.

With the ninth feature of the present invention, when the engine is in a cold and stopped state, the automatic choke system allows opening of the choke valve, and the governor device maintains the throttle valve in the fully opened state. During idling immediately after a cold start of the engine, the throttle valve is closed from the fully opened position to the idling opened position by the operation of the governor device. During this throttle valve opening process, the choke valve is forcibly released from the fully closed position to a half-opened state by the operation of the choke valve forcibly-opening means. Therefore, the air-fuel mixture produced in the intake path is regulated to a mixture ratio suitable for idling of the engine, thereby securing a stable idling state, and avoiding deterioration of the fuel saving performance due to a delay in opening the choke valve.

According to a tenth feature of the present invention, in addition to the ninth feature, the output section and the choke forcibly-opening means are arranged so that the opening of the choke valve by one of the output section and the choke forcibly-opening means is not impeded by the other.

With the tenth feature of the present invention, the output section and the choke valve forcibly-opening means are capable of appropriately controlling the opening of the choke valve without interfering with each other.

These and other objects, features and advantages of the present invention will become apparent from the following detailed description of a preferred embodiment of the present invention with reference to the accompanying drawings.

DESCRIPTION OF THE PREFERRED EMBODIMENT

A preferred embodiment of the present invention will be described with reference to the accompanying drawings.

Figure 1:
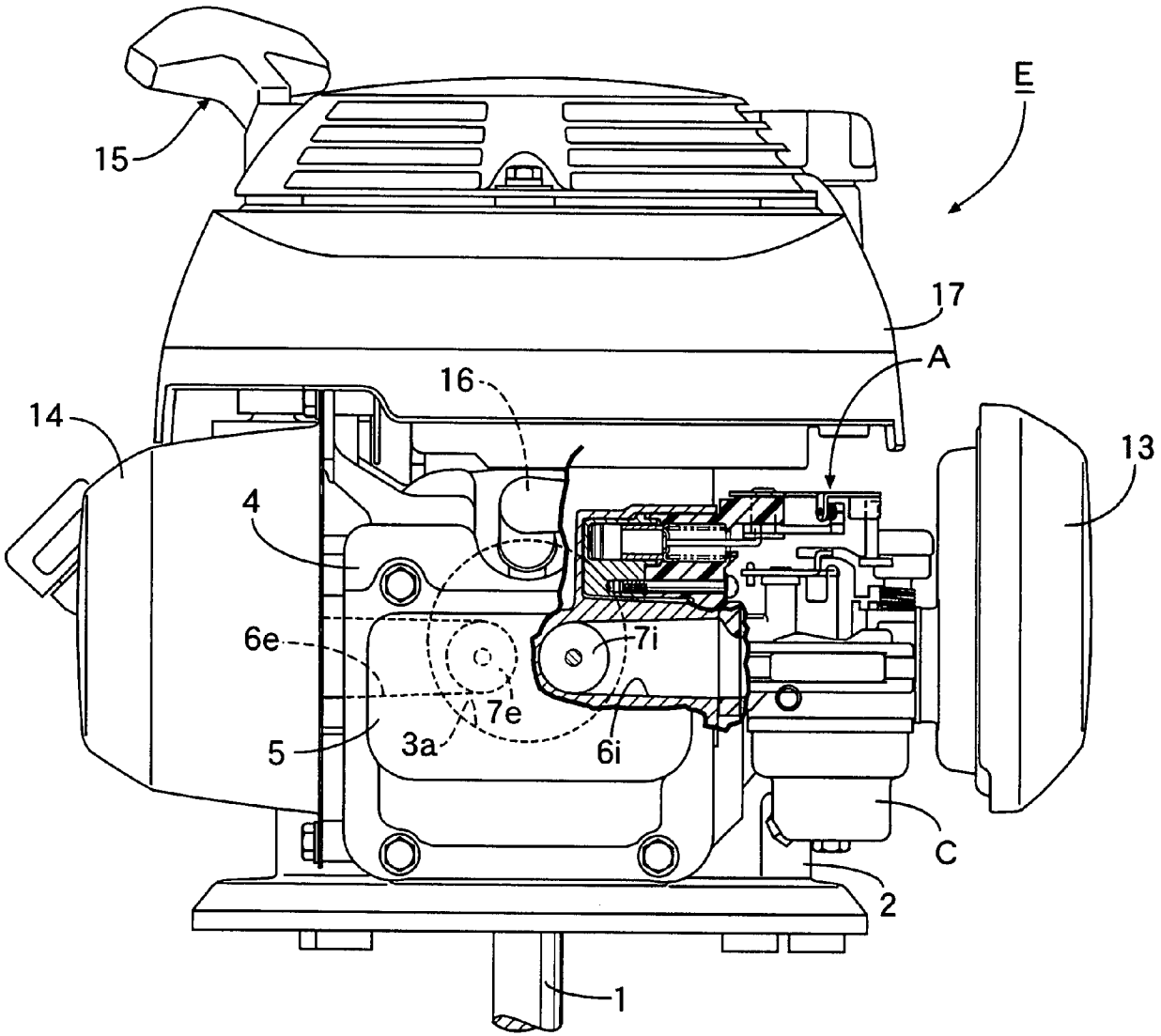
FIG. 1 is a partially cutaway front view of a general-purpose engine partly in longitudinal section.
Figure 2:
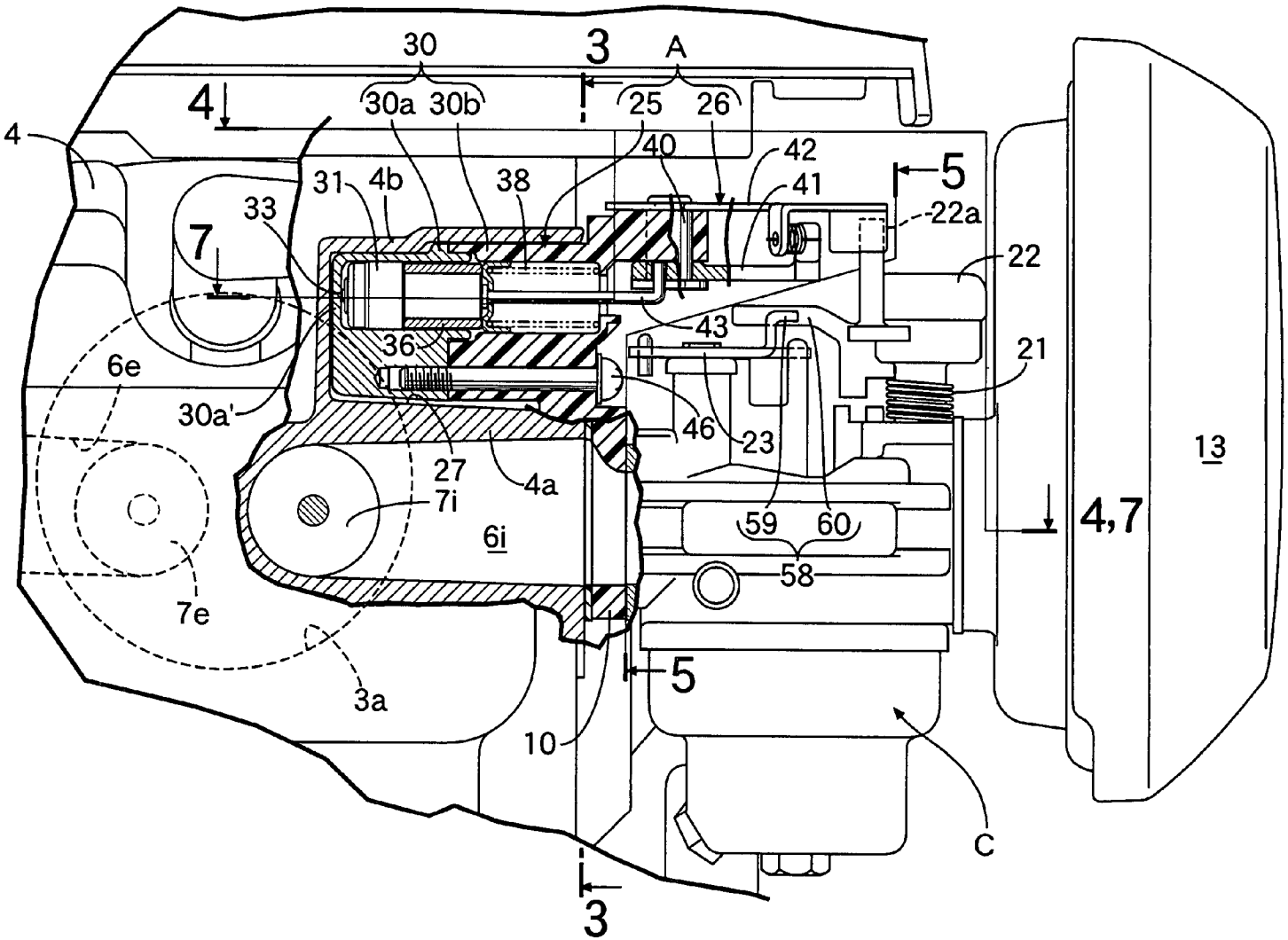
FIG. 2 is an enlarged view of an essential portion of the engine shown in FIG. 1.
Figure 3:
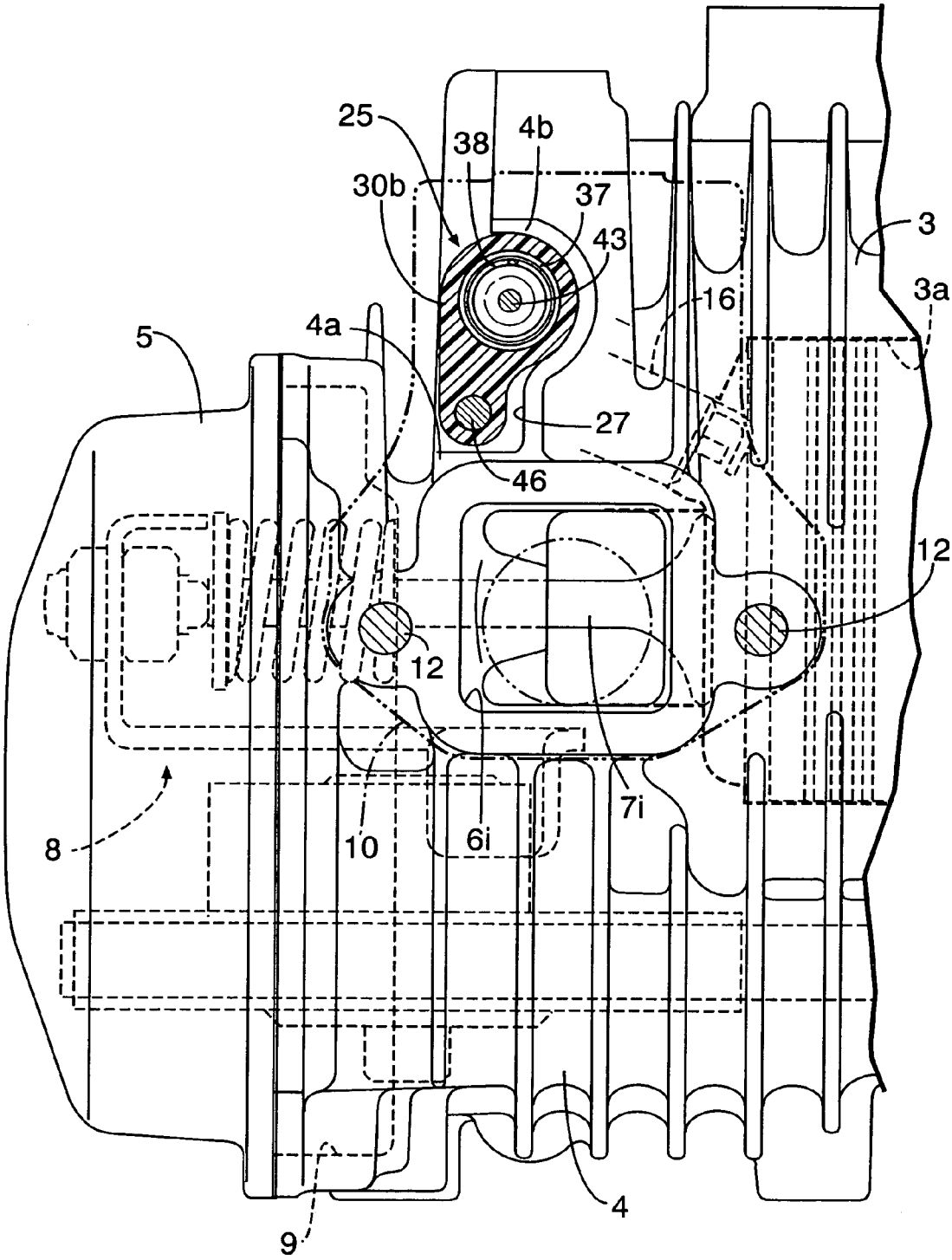
FIG. 3 is a sectional view taken along line 3—3 in FIG. 2.

In FIGS. 1 to 3, a reference character E denotes a four-cycle engine serving as a motive power source of various working machines. The engine E comprises: a crank case 2 vertically supporting a crankshaft 1; a cylinder block 3 horizontally projecting out of the crank case 2 and having a cylinder bore 3*a*; and a cylinder head 4 formed integrally with an outer end portion of the cylinder block 3. Provided in the cylinder head 4 are an intake port 6*i* and an exhaust port 6*e* opened and closed by an intake valve 7*i* and an exhaust valve 7*e*, respectively, and a valve operating chamber 9 accommodating a valve mechanism 8 for operating the intake valve 7*i* and the exhaust valve 7*e*. A head cover 5 for closing the valve operating chamber 9 is joined to an end surface of the cylinder head 4.

Outer ends of intake port 6*i* and the exhaust port 6*e* respectively open in one side face and the opposed other side face of the cylinder head 4. A carburetor C having an intake path 11 communicating with the intake port 6*i* is joined to the one side face by a plurality of pass-through bolts 12, with a plate-shaped heat-insulating member 10 interposed between the one side face of the cylinder head 4 and the carburetor C. The heat-insulating member 10 is made of a thermosetting synthetic resin such as a phenolic resin having a high heat-insulating property. The heat-insulating member 10 suppresses the amount of heat transmitted from the engine E to the carburetor C. An exhaust muffler 14 communicating with the exhaust port 6*e* is attached to the other side face of the cylinder head 4. A fuel tank 17 and a recoil-type starter 15 are provided in an upper portion of the engine E. Reference numeral 16 in FIG. 1 denotes an ignition plug screwed into the cylinder head 4.

Figure 4:
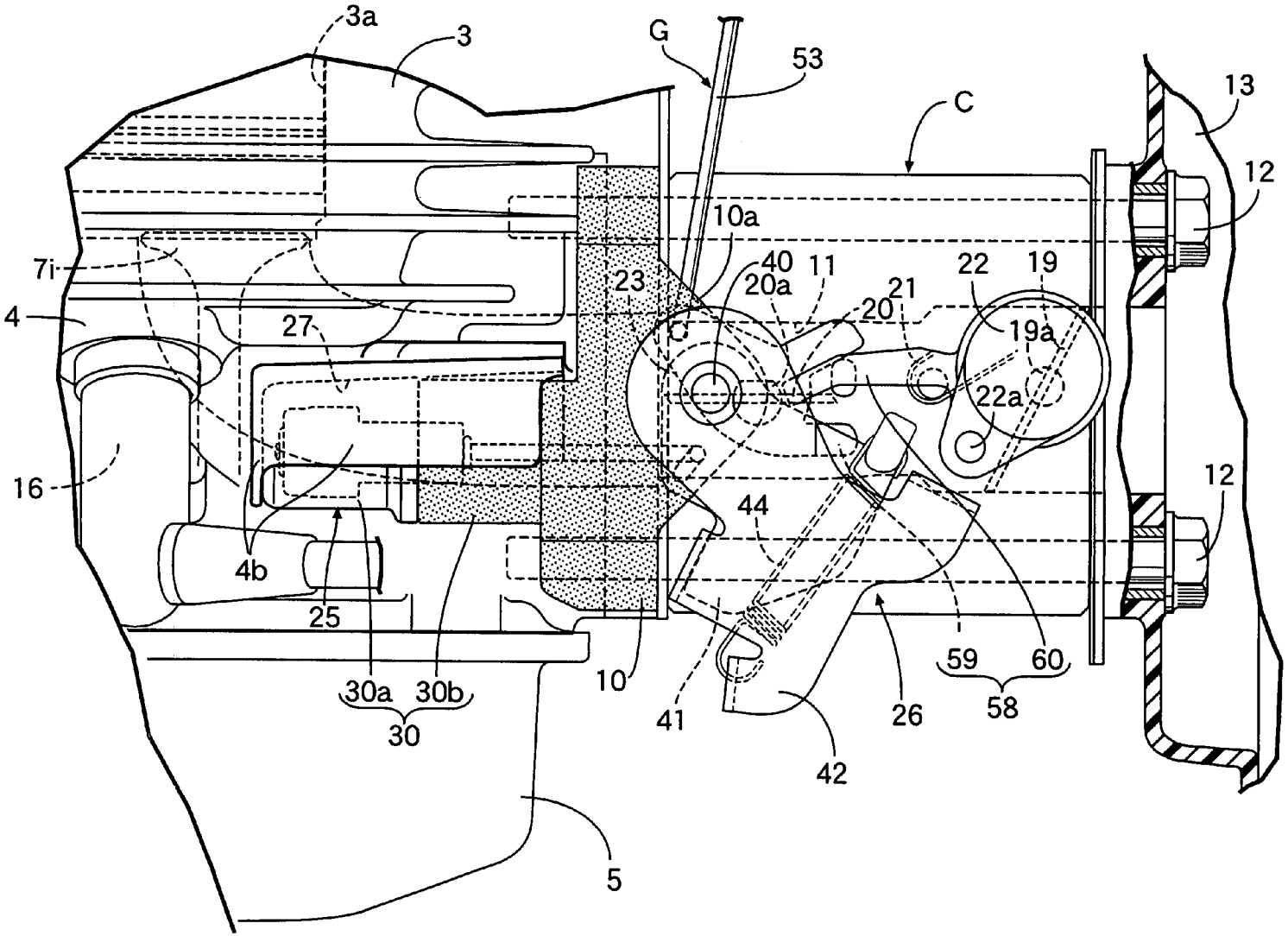
FIG. 4 is a sectional view taken along line 4—4 in FIG. 2.

As shown in FIGS. 2 and 4, an air cleaner 13 is attached to the carburetor C to communicates with an upstream portion of the intake path 11. A choke valve 19 is provided in an upstream portion of the intake path 11 of the carburetor C, and a throttle valve 20 is provided in a downstream portion of the intake path 11. Also, a fuel nozzle (not shown) is provided to open at a position between the two valves 19 and 20. The choke valve 19 and the throttle valve 20 are butterfly valves respectively supported on valve stems 19*a* and 20*a* which are rotatably supported on the carburetor C.

Referring to FIG. 4, the valve stem 19*a* of the choke valve 19 is offset toward one side of a center line of the intake path 11; and the choke valve 19 is inclined with respect to the center line of the intake path 11 so that the large-turning-radius side of the choke valve 19 is positioned downstream of the small-turning-radius side of the choke valve 19 when the choke valve 19 is fully closed. A choke lever 22 is attached to an outer end portion of the valve stem 19*a* projecting out of the carburetor C. The choke lever 22 is a hollow cylindrical member, and fitted around the valve stem 19*a* so as to be rotatable relative to the valve stem 19*a*. The choke lever 22 is internally connected to the valve stem 19*a* through a well-known relief spring (not shown). The fully-opened position and the fully-closed position of the choke valve 19 are defined by abutment of the choke lever 22 against a stopper (not shown) which is provided on an external wall portion of the carburetor C.

When the intake negative pressure of the engine E exceeds a predetermined value while the choke valve 19 is in a fully-closed or slightly-closed state, the choke valve 19 opens to a degree of opening at which (A) the difference between (1) the turning moment produced by the intake negative pressure acting on the large-turning-radius side of the choke valve 19 and (2) the turning moment produced by the intake negative pressure acting on the small-turning-radius side of the choke valve 19, balances with (B) the turning moment produced by the above-mentioned relief spring.

A choke return spring 21 urging the choke lever 22 toward the choke valve 19 closing side is connected to the choke lever 22. An automatic choke system A for automatically controlling the opening of the choke valve 19 in correspondence to a change in temperature of the engine E is placed to face the choke lever 22.

The automatic choke system A will be described with reference to FIGS. 2 to 11.

Referring first to FIGS. 2 to 6, the automatic choke system A comprises: a temperature sensing section 25 which receives heat from the cylinder head 4 of the engine E, particularly from a portion around the intake port 6*i*; and an output section 26 which connects the temperature sensing section 25 to the choke lever 22 and which transmits a heat receiving operation of the temperature sensing section 25 to the choke lever 22 as a movement of the choke valve 19 in the opening direction. The temperature sensing section 25 has a cylindrical housing 30 placed in an accommodation chamber 27 which is formed by a peripheral wall 4*a* of the intake port 6*i* and a surrounding wall 4*b* (see FIGS. 2 and 3) rising from an upper portion of the peripheral wall 4*a*. The accommodation chamber 27 is opened in one side face of the cylinder head 4 so as to form an inlet at its one end, as is the intake port 6*i*. The accommodation chamber 27 is closed at the other end facing a center of the cylinder head 4. Also, the accommodation chamber 27 is appropriately opened at one side in consideration of the formability of the surrounding wall 4*b* and the assemblability of the temperature sensing section 25.

The housing 30 comprises: a cup-shaped first portion 30*a* made of a metal having a high heat conductivity, e.g., Al and including a bottom 30*a*'; and a cylindrical second portion 30*b* made of a synthetic resin having a high heat insulating property, e.g., a phenolic resin, and spigot-fitted and connected to the opening end of the first portion 30*a* by a screw 45 (see FIG. 2). The second portion 30*b* is provided integrally with the heat insulating member 10 which is interposed between the cylinder head 4 and the carburetor C. Thus, the housing 30 is attached to the cylinder head 4 without providing any special attachment member.

The first portion 30*a* is placed so that its bottom 30*a*' faces an inner portion of the accommodation chamber 27, i.e., a central portion (high-temperature portion) of the cylinder head 4. The bottom 30*a*' and the peripheral wall of the first portion 30*a* are arranged so that they contact the inner surface of the accommodation chamber 27 or are situated away from the inner surface with a very small gap therebetween. The second portion 30*b* is placed at the inlet side of the accommodation chamber 27, i.e., the side away from the center of the cylinder head 4.

Figure 10:
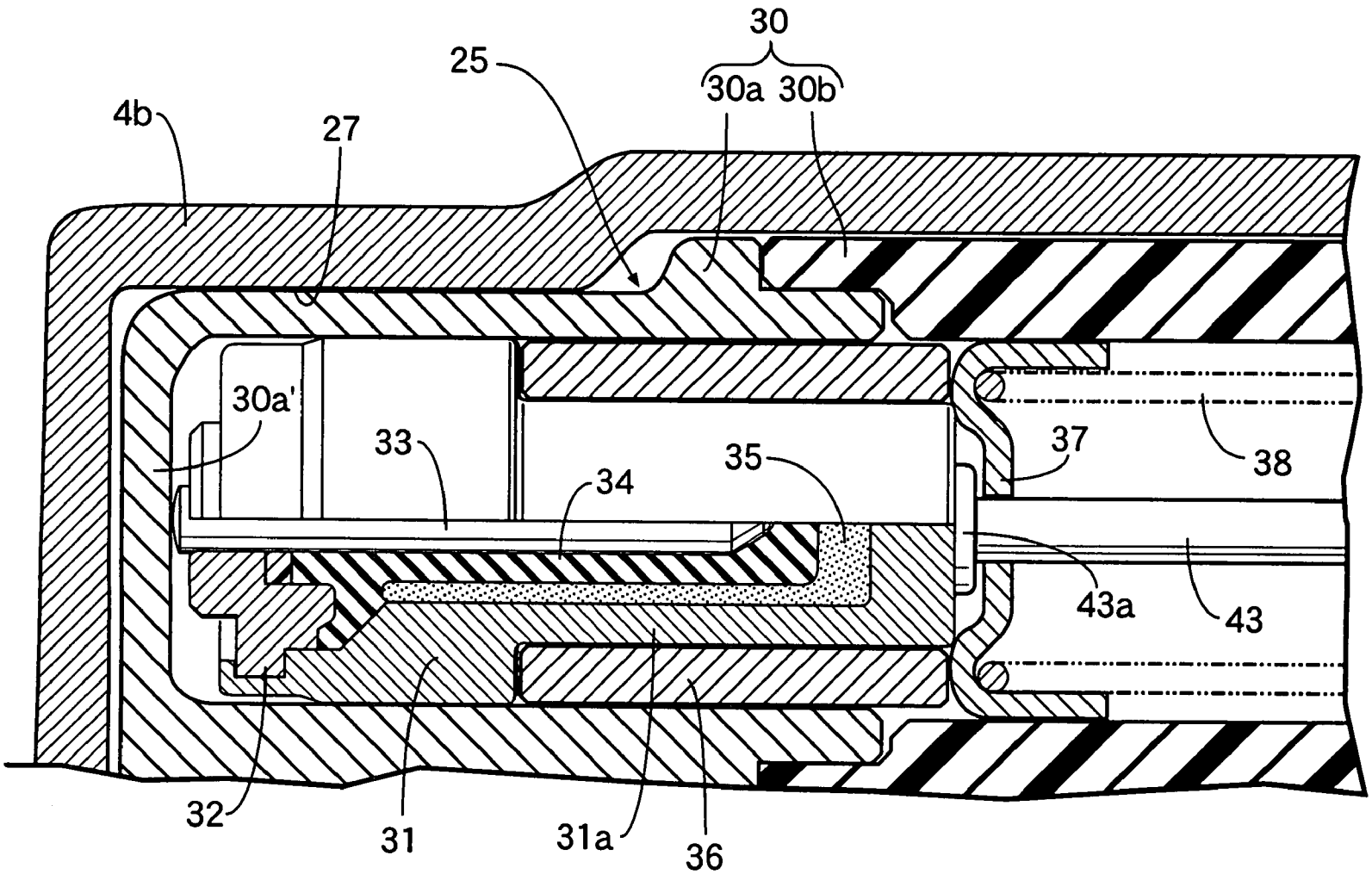
FIG. 10 is an enlarged view of a temperature sensing section of the automatic choke system shown in FIG. 6.
Figure 11:
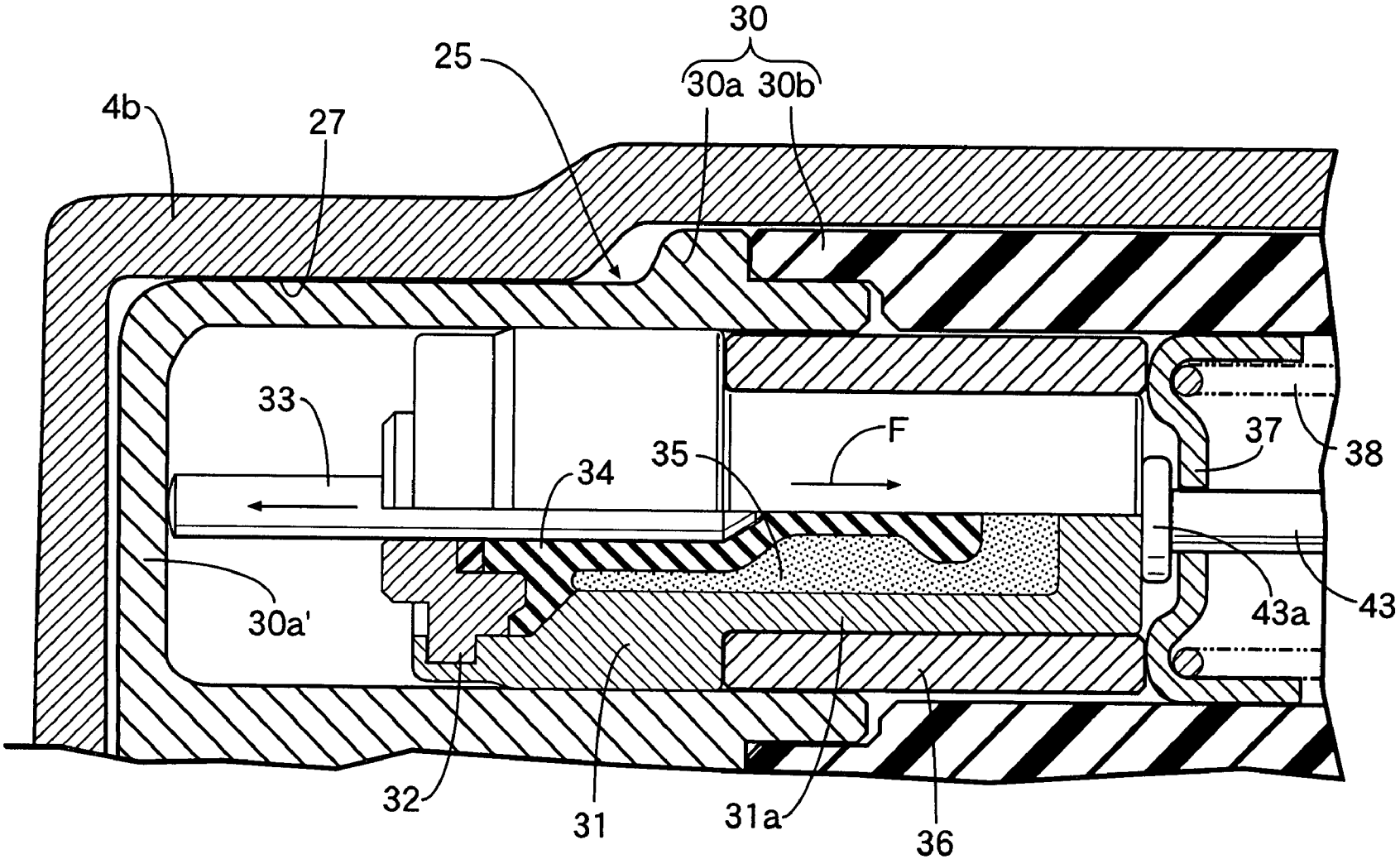
FIG. 11 is a diagram for explaining the operation in correspondence with FIG. 10.

As shown in FIG. 10, the temperature sensing section 25 includes: a bottomed movable cylinder 31 made of a metal having a high heat conductivity, e.g., Al; a guide member 32 crimp-joined to the opening end of the movable cylinder 31; a rod-shaped stationary piston 33 slidably supported on the guide member 32 to pass therethrough; an elastic bag 34 covering the stationary piston 33 in the movable cylinder 31 and having its opening end fluid-tightly clamped between the movable cylinder 31 and the guide member 32; and wax 35 contained in the movable cylinder 31 in a sealed manner so as to cover the elastic bag 34. The movable cylinder 31 is slidably fitted in the first portion 30*a* of the housing 30, with the outer end of the stationary piston 33 maintained in contact with the inner surface of the bottom 30*a*' of the first portion 30*a* of the housing 30.

When the wax 35 is heated, it expands to squeeze and compress the elastic bag 34 so that the stationary piston 33 is pushed out of the guide member 32. However, since the stationary piston 33 cannot move as having its outer end maintained in contact with the inner surface of the bottom 30*a*' of the first portion 30*a*, the movable cylinder 31 receives a reaction from the stationary piston 33 to advance in the first portion 30*a* in the direction of arrow F to move away from the bottom 30*a*' (see FIG. 11).

One half of the outer peripheral surface of the movable cylinder 31 on the side opposite from the guide member 32 has a small diameter to form a small-diameter portion 31*a*, around which a distance collar 36 is fitted. A coiled return spring 38 is provided under compression between a retainer 37 in contact with the distance collar 36 and the heat insulating member 10, thereby urging the movable cylinder 31 toward the outer end of the stationary piston 33 via the distance collar 36. Thus, the retainer 37 is clamped between the distance collar 36 and the return spring 38.

Figure 5:
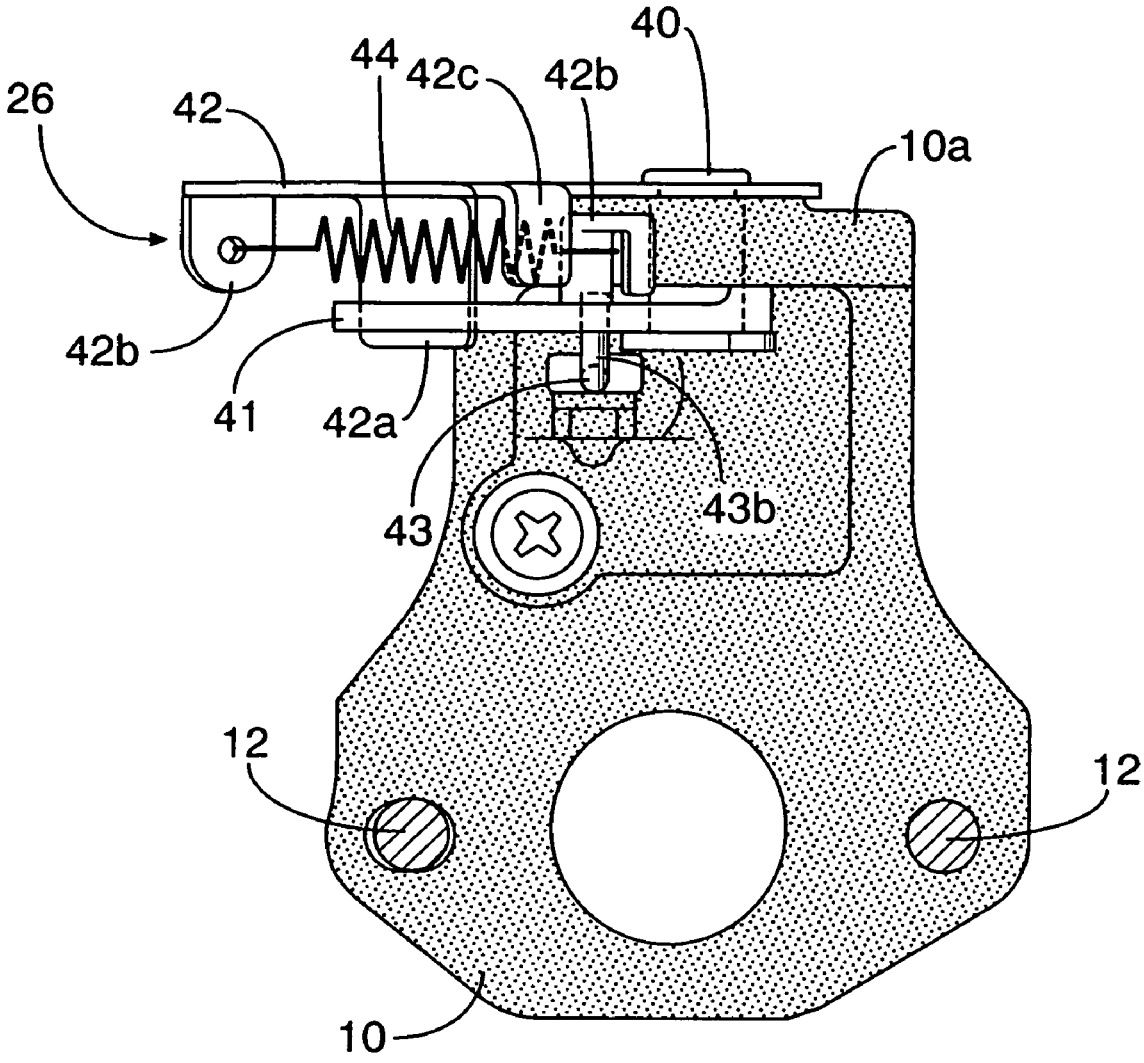
FIG. 5 is a sectional view taken along line 5—5 in FIG. 2.
Figure 6:
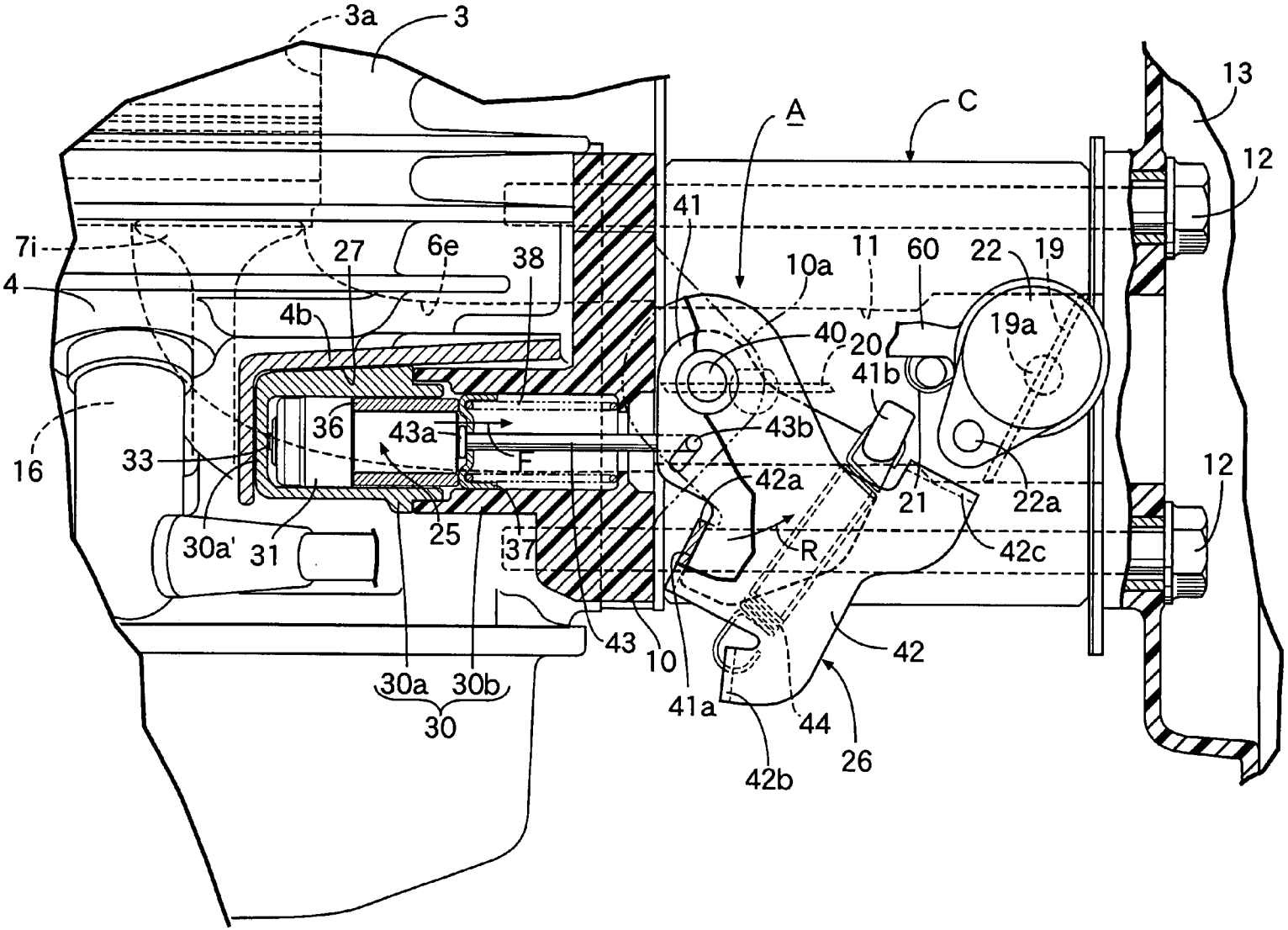
FIG. 6 is a sectional view taken along line 6—6 in FIG. 2.

As shown in FIGS. 5 and 6, the output section 26 includes: a rod 43 passing through the heat insulating member 10 and having one end 43*a* connected to the retainer 37; and independently-turnable first and second levers 41 and 42 which are supported by a common axis 40 on two side surfaces of a bracket 10*a* which is formed integrally with the heat insulating member 10*e*. The other end 43*b* of the rod 43 bent into an L-shape is connected to the first lever 41. By the movement of the rod 43 in the axial direction following the advance F of the movable cylinder 31, the first lever 41 is turned in the direction of arrow R as shown in FIG. 6. The connection of the rod 43 to the retainer 37 is made by clamping an expanded end portion 43*a* of the rod 43 between the retainer 37 and an end surface of the movable cylinder 31.

The first and second levers 41 and 42 have abutting portions 41*a* and 42*a* which detachably abut against each other in a direction in which the first and second levers are turned. The abutting portions 41*a* and 42*a* are moved away from each other when the first lever 41 is turned in the direction of arrow R relative to the second lever 42. The first and second levers 41 and 42 have spring engagement portions 41*b* and 42*b*. Opposite ends of a connection spring 44 for urging the levers 41 and 42 in the turning direction to abut against the abutting portions 41*a* and 42*a*, are engaged with the spring engagement portions 41*b* and 42*b*.

An operating arm 42*c* which is operably opposed to an action-receiving pin 22*a* of the choke lever 22, is formed integrally with the second lever 42. When the second lever 42 is turned in the direction of arrow R, the operating arm 42*c* rotates the choke lever 22 in the direction to open the choke valve 19.

Figure 12:
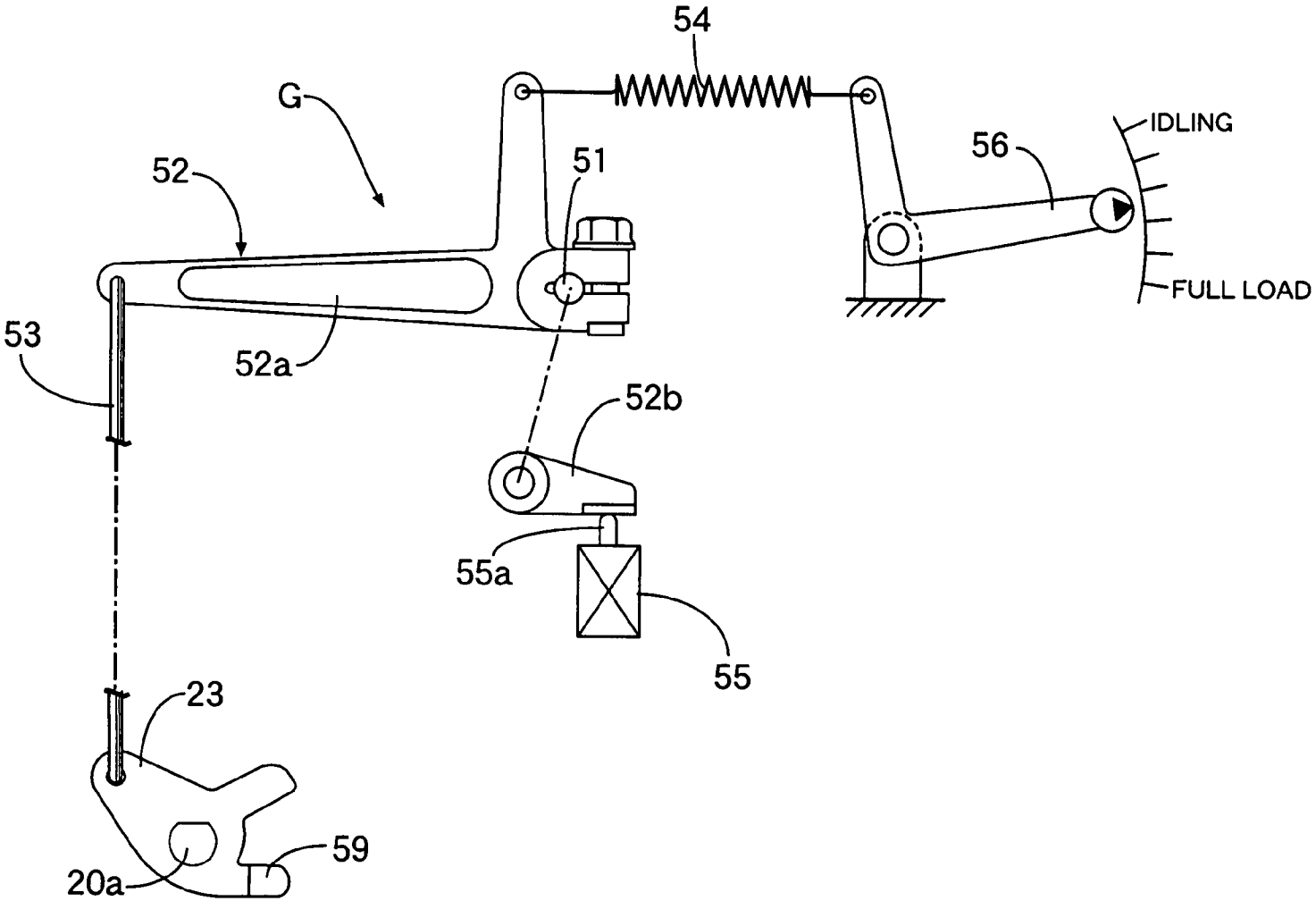
FIG. 12 is a schematic side view of a governor device.

A governor device G for automatically controlling opening and closing of the throttle valve 20 will be described with reference to FIG. 12. A throttle lever 23 is fixed to an outer end portion of the valve stem 20*a* of the throttle valve 20. A long arm portion 52*a* of a governor lever 52 is fixed to an outer end of a rotation support shaft 51 which is supported on the engine E, and is connected to the throttle lever 23 via a link 53. An output control lever 56 is supported on the engine E and the other components to be capable of turning from an idling position to a full-load position, and is connected to the governor lever 52 via a governor spring 54. The governor spring 54 always urges the throttle valve 20 in the direction to open the throttle valve 20. The spring load of the governor spring 54 is increased and decreased by turning the output control lever 56 from the idling position to the full-load position or in the opposite direction thereto.

An output shaft 55*a* of a well-known centrifugal governor 55 driven by the crankshaft 1 of the engine E is connected to a short arm portion 52*b* of the governor lever 52. The output of the centrifugal governor 55 which increases with the increase in rotational speed of the engine E, acts on the short arm portion 52*b* in the direction to close throttle valve 20.

When the engine E is stopped, the throttle lever 50 is maintained at a throttle valve 20 closing position C by the set load of the governor spring 54. When the engine E is running, the opening of the throttle valve 20 is automatically controlled by the balance between the moment of the governor lever 52 produced by the output of the centrifugal governor 55 and the moment of the governor lever 52 in correspondence to the set load of the governor spring 54.

Figure 13:
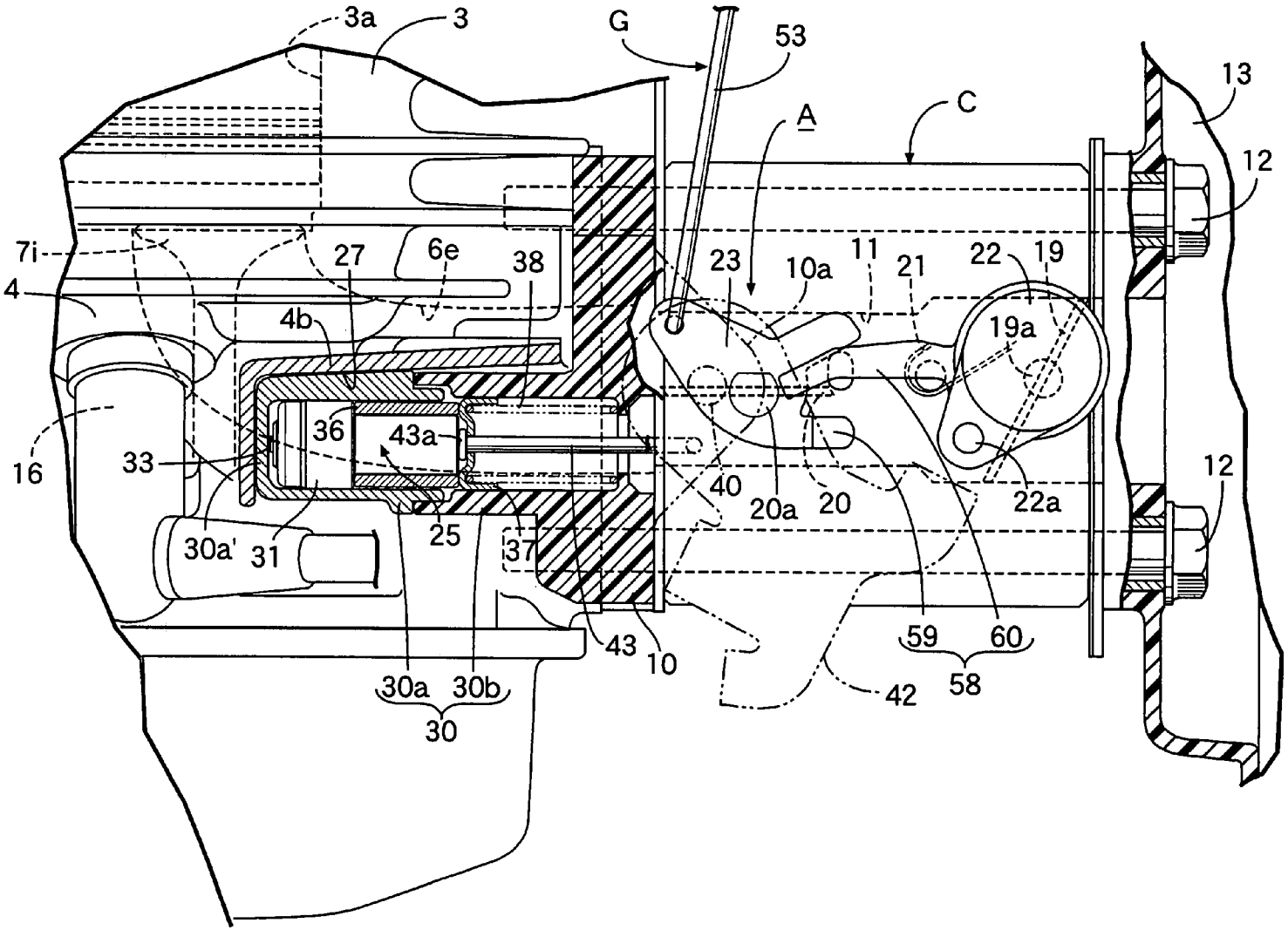
FIG. 13 is a side view of a portion including a choke valve forcibly-opening means.

As shown in FIGS. 2 and 13, a drive arm 59 is formed integrally with the throttle lever 50, and a follower arm 60 associated with the driven arm 59 is formed integrally with the choke lever 33. When the throttle valve 20 is turned from the fully opened position to the idling opened position, the drive arm 59 presses the follower arm 60 in the choke valve 19 opening direction. The drive arm 59 and the follower arm 60 constitute a choke valve forcibly-opening means 58.

The operation of the present embodiment will now be described.

When the engine E is in a cold and stopped state, the wax 35 in the temperature sensing section 25 is in a shrunk state, and therefore the movable cylinder 31 is maintained in a retreat position near the bottom 30*a*' of the first portion 30*a* of the housing 30 by the resilient force of the return spring 38, as shown in FIG. 10. Correspondingly, the operating arm 42*c* of the second lever 42 of the output section 26 is held at a position away from the choke lever 22, and the choke lever 22 is maintained in the choke valve 19 closing position by the urging force of the choke return spring 21, as shown in FIG. 6.

On the other hand, since the centrifugal governor 55 is not operating, the throttle valve 20 is maintained in the fully-opened state by the governor spring 54 (see FIG. 13). In this state, when the output control lever 56 is set in the idling position, the load of the governor spring 54 is set to the smallest value or zero.

When the crankshaft 1 is then cranked by operating the recoil starter 15 in order to start the engine E, a high negative pressure is produced in the intake path 11 downstream of the choke valve 19 in the carburetor C, thereby injecting a comparatively large amount of fuel through a fuel nozzle which opens at the corresponding position to increase the fuel concentration of the air-fuel mixture produced in the intake path 11, thus smoothly starting the engine E.

Figure 14:
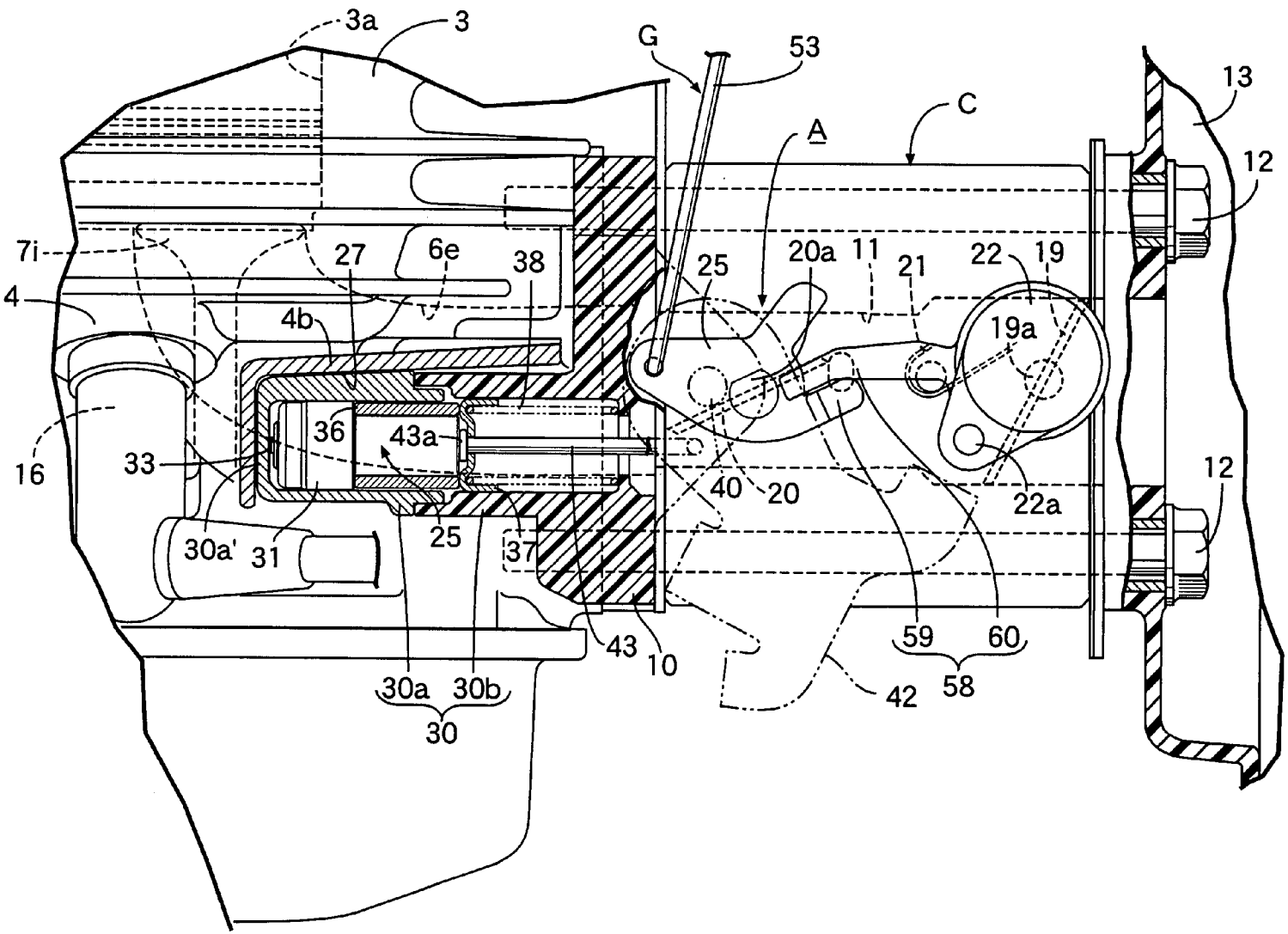
FIG. 14 is a diagram for explaining the operation of the choke valve forcibly-opening means in correspondence to FIG. 13.
Figure 15:
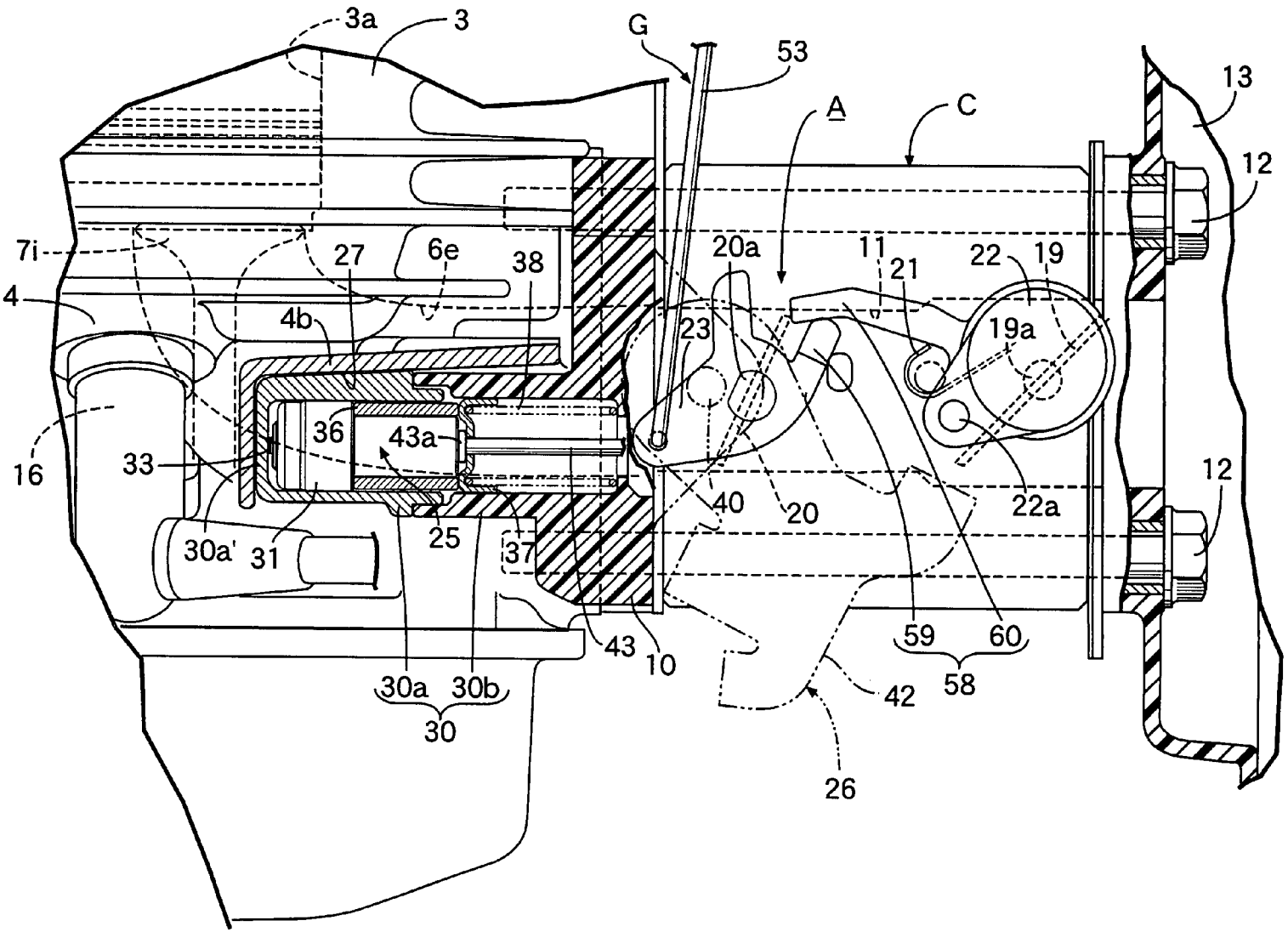
FIG. 15 is another diagram for explaining the operation of the choke valve forcibly-opening means.

When the engine E is started, the centrifugal governor 55 produces the output corresponding to the rotational speed of the crankshaft 1. The governor lever 52 is turned to the position at which the moment on the governor lever 52 produced by this output and the moment on the governor lever 52 in correspondence to the minimum load of the governor spring 54 balance with each other, whereby the throttle valve 20 is automatically closed to the idling opened position. The drive arm 59 integral with the throttle lever 23 then presses the follower arm 60 integral with the choke lever 22 against the urging force of the choke return spring 21, thereby forcibly releasing the choke valve 19 from the fully closed position to a half-opened state, as shown in FIGS. 14 and 15. At this time, the action-receiving pin 22*a* of the choke lever 22 only moves away from the second lever 42 of the output section 26 in the automatic choke system A, and thus the output section 26 does not interfere with the forced valve opening of the choke valve 19 caused by the drive arm 59. Therefore, the air-fuel mixture produced in the intake path 11 is regulated to a mixture ratio suitable for idling of the engine E, thereby securing a stable idling state and avoiding deterioration in the mileage due to delay in opening the choke valve 19.

If the output control lever 56 is turned from the idling position to a suitable load position during warming-up of the engine E to apply a load of a working machine or the like onto the engine E, the load of the governor spring 54 is correspondingly increased to increase the opening degree of the throttle valve 20 at which the load of the governor spring 54 and the output of the centrifugal governor 55 balance with each other. With this increase in the opening degree of the throttle valve 20, the drive arm 59 retreats relative to the follower arm 60. However, the follower arm 60 of the choke lever 22 follows the retreating of the drive arm 59 by the urging force of the choke return spring 21, thereby closing the choke valve 19 again. As a result, when the intake negative pressure produced at a downstream position in the intake path 11 exceeds a predetermined value, the choke valve 19 is opened to the opening degree at which the difference between the turning moment produced by the intake negative pressure acting on the large-turning-radius side of the choke valve 19 and the turning moment produced by the intake negative pressure acting on the small-turning-radius side of the choke valve 19, balance with the turning moment produced by the above-mentioned relief spring in the choke lever 22, thereby preventing the excessively large fuel concentration of the air-fuel mixture produced in the intake path 11 and securing a good warming-up state.

Figure 7:
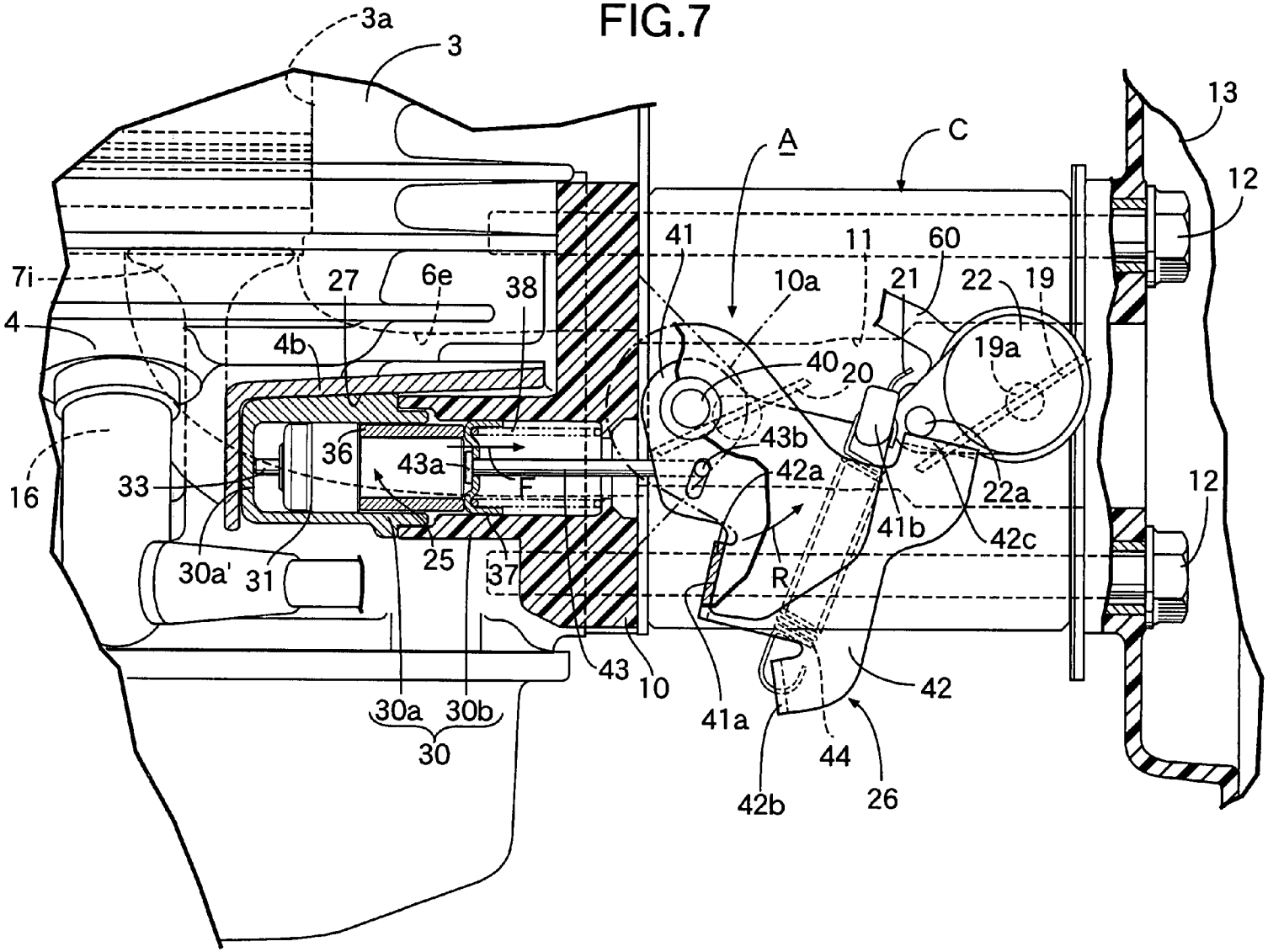
FIG. 7 is a diagram for explaining the operation of the automatic choke system in correspondence to FIG. 6.

As the warming-up operation of the engine E progresses, the temperature of the cylinder head 4 is increased; the temperature sensing section 25 in the accommodation chamber 27 near the intake port 6*i* is heated through the inner wall of the accommodation chamber 27; the wax 35 in the movable cylinder 31 is thermally expanded to squeeze the elastic bag 34, so that the stationary piston 33 is pushed outward; the reaction of the stationary piston 33 advances the movable cylinder 31 in the direction of arrow F against the resiliency force of the return spring 38; and this advancement turn the first lever 41 in the direction of arrow R via the rod 43. Since the first lever 41 and the second lever 42 are originally maintained in a connected state by the urging force of the connection spring 44 such that the abutting portions 41*a* and 42*a* abut against each other, the second lever 42 is turned integrally with the first lever 41, and the operating arm 42*c* turns the action-receiving pin 22*a*, i.e., the choke lever 22, in the choke valve 19 opening direction against the urging force of the choke return spring 21, as shown in FIG. 7.

Figure 8:
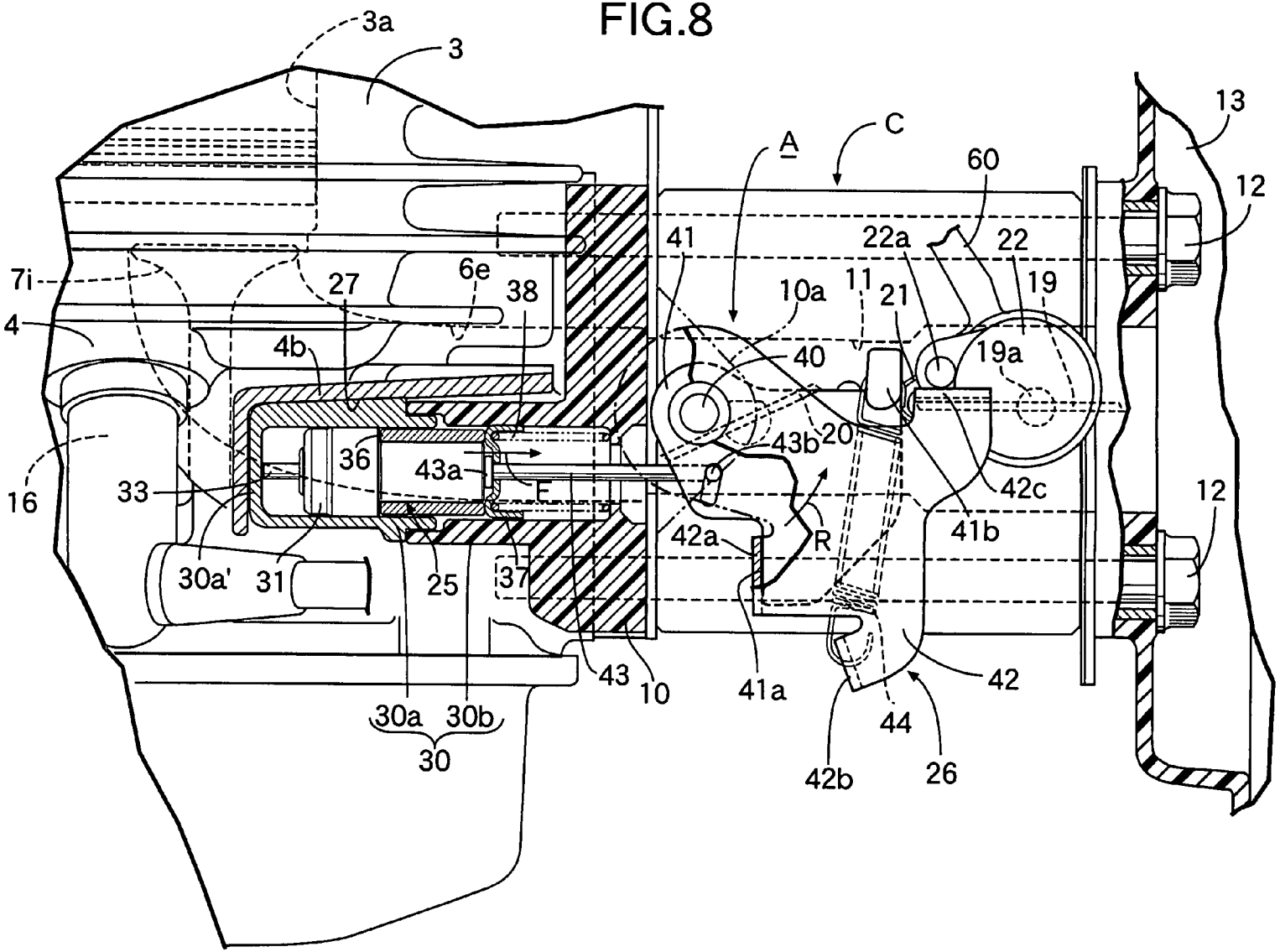
FIG. 8 is another diagram for explaining the operation of the automatic choke system.

Therefore, the opening degree of the choke valve 19 increases in correspondence to the increase in the temperature in the accommodation chamber 27, to reduce the negative pressure on the fuel nozzle in the intake path 11 in correspondence to the progress of warming-up of the engine E, thereby reducing the amount of fuel injected through the fuel nozzle. Thus, it is possible to appropriately correct the air-fuel ratio in the air-fuel mixture produced in the intake path 11. By the time when warming-up of the engine E is completed, the temperature in the accommodation chamber 27 becomes sufficiently high, and the choke valve 19 is controlled so as to be fully opened as shown in FIG. 8.

Figure 16:
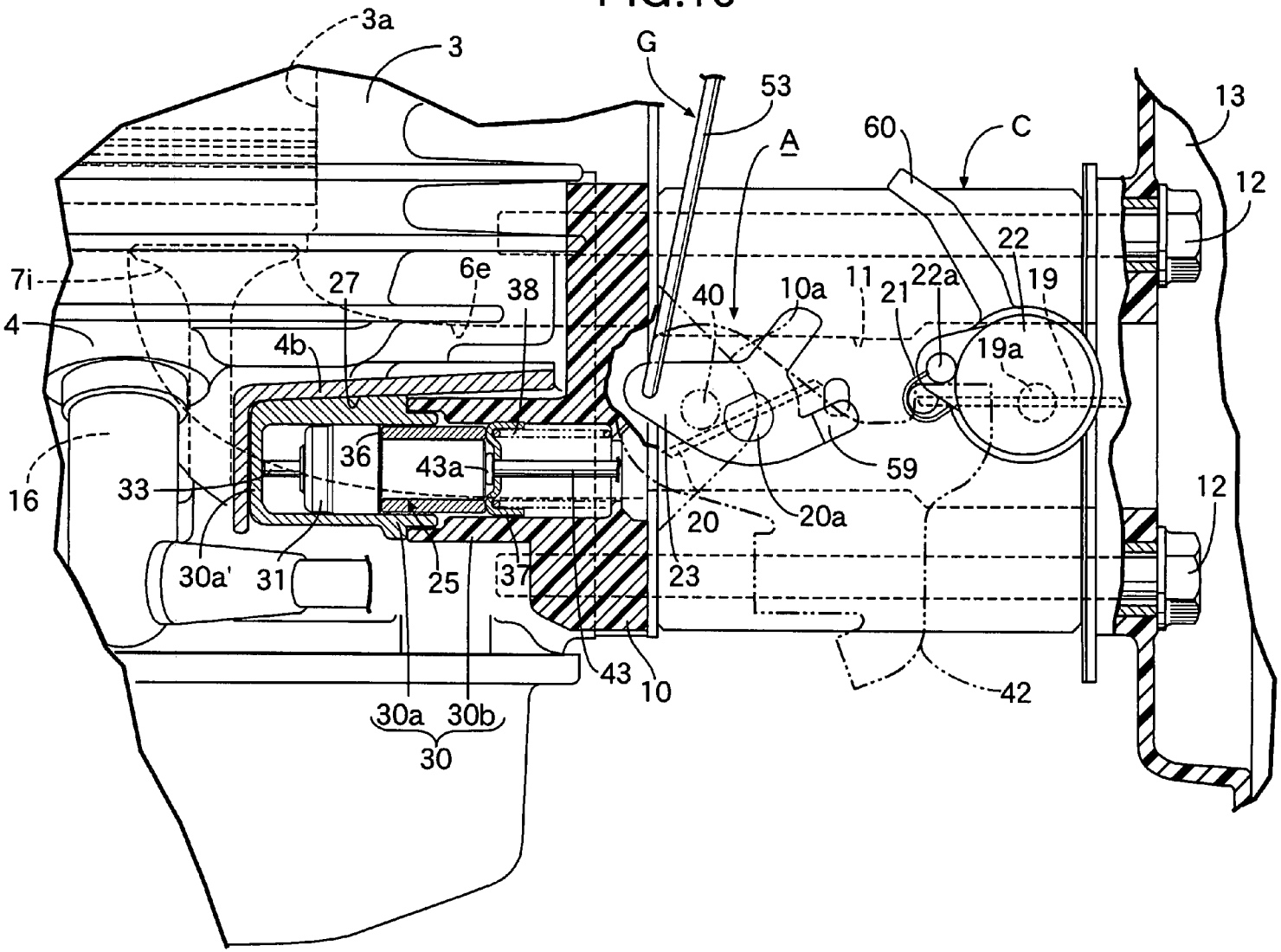
FIG. 16 is still another diagram for explaining the operation of the choke valve forcibly-opening means.

During the warming-up, as shown in FIG. 16, the follower arm 60 moves away from the drive arm 59 of the throttle lever 23 following the valve opening of the choke valve 19 without being interfered with by the drive arm 59. Thus, it is possible to appropriately open the choke valve 19.

Figure 9:
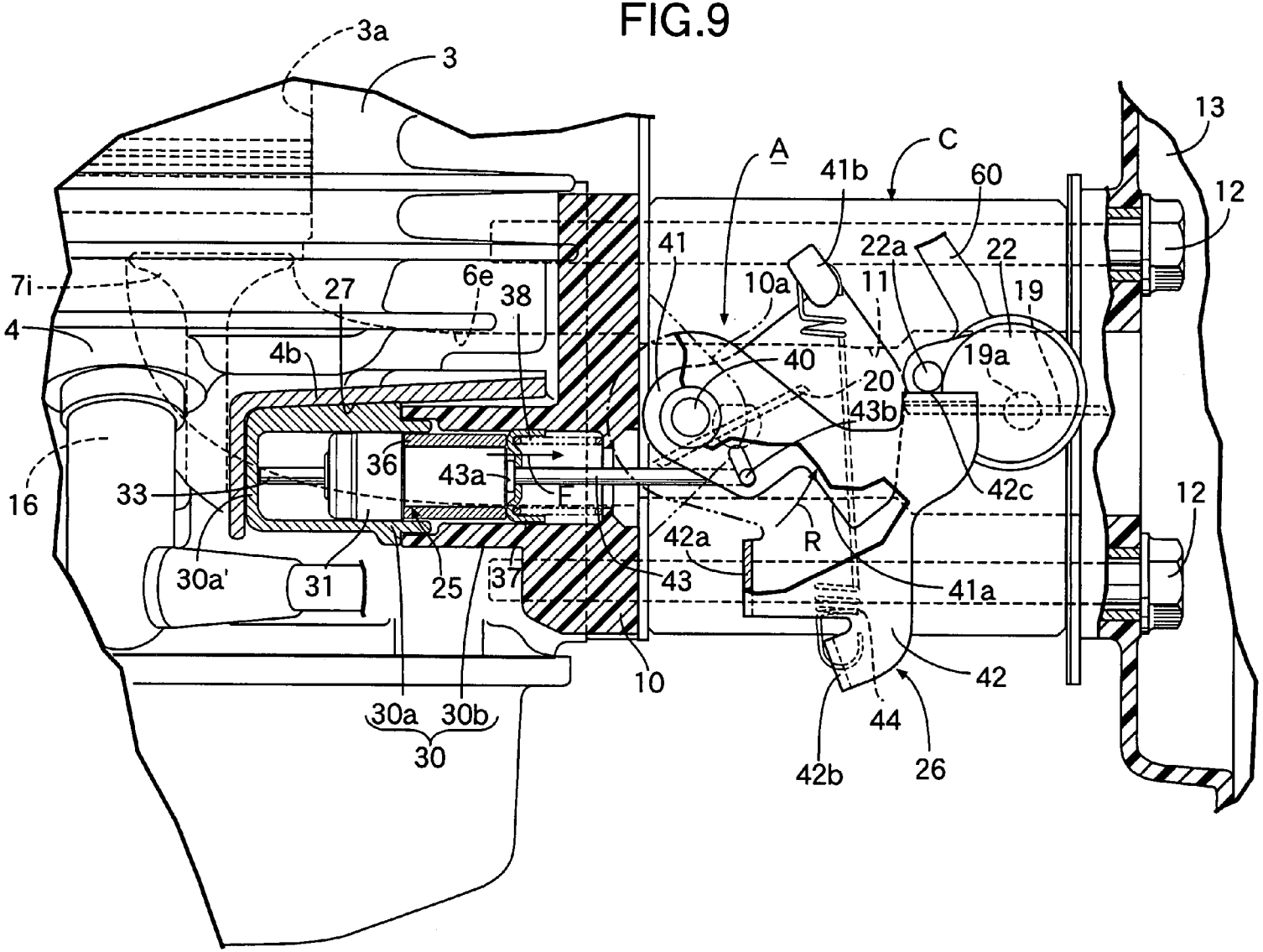
FIG. 9 is still another diagram for explaining the operation of the automatic choke system.

Thereafter, as the temperature of the cylinder head 4 further rises to increase the temperature in the accommodation chamber 27, the wax 35 is further thermally expanded to excessively advance the movable cylinder 31, thereby turning the first lever 41 in the direction of arrow R through the rod 43. However, since the choke lever 22 in the fully-opened position inhibits the second lever 42 from turning further, only the first lever 41 is turned in the direction of arrow R while stretching the connection spring 44, thereby moving the abutting portion 41*a* of the first lever 41 away from the abutting portion 42*a* of the second lever 42, as shown in FIG. 9. Thus, the overstroke action of the movable cylinder 31 of the temperature sensing section 25 is absorbed by this stretching of the connection spring 44. This means that any load exceeding the set load of the connection spring 44 does not act on the components from the automatic choke system A to the choke valve 19. Thus, it is possible to avoid generation of any excessive stress in each component to secure durability of the component. Moreover, since the first and second levers 41 and 42 turnable relative to each other are mounted on the bracket 10*a* via the common axis 40, thereby reducing the number of components in the output section 26 and simplifying the structure.

When the operation of the engine E is thereafter stopped, the accommodation chamber 27 remains in a high-temperature state as long as the high-temperature state of the engine E continues. In this state, the temperature sensing section 25 operates so as to maintain the advanced state of the movable cylinder 31, and hold the choke valve 19 opening state through the output section 26. Therefore, in this state, the follower arm 60 of the choke lever 22 situates far away the drive arm 59 of the throttle lever 23, so that the follower arm 60 does not interfere with returning of the throttle valve 20 to the fully opened position by the load 5of the governor spring 54. Therefore, when the engine E is restarted in the high-temperature state, the opened state of the choke valve 19 is maintained to prevent the excessively large fuel concentration in the air-fuel mixture, thus securing a good restartability.

If the engine E is cooled after being stopped, the movable cylinder 31 retreats in the temperature sensing section 25 due to the thermal shrinkage of the wax 35 and the returning operation of the return spring 38. The output section 26 then allows the choke lever 22 to be turned in the choke valve 19 closing direction by the choke return spring 21.

During the running of the engine E, the peripheral portion of the intake port 6*i* in the cylinder head 4 is always cooled by intake air flowing in the intake port 6*i*. Therefore, a temperature characteristic corresponding to the progress of warming-up operation can be maintained without being affected by the fluctuation in the load on the engine E. Consequently, the temperature sensing section 25 placed near the intake port 6*i* can appropriately operate in correspondence to the progress of the warming-up operation irrespective of the fluctuation of the load on the engine E. Thus, it is possible to always appropriately control the opening of the choke valve 19, thereby contributing to improvement in fuel consumption and emission characteristics of the engine E.

In particular, in the case where the temperature sensing section 25 is placed in the accommodation chamber 27 formed in the cylinder head 4 by the peripheral wall 4*a* of the intake port 6*i* and the surrounding wall 4*b* rising from one side of the peripheral wall 4*a*, the operating characteristic of the temperature sensing section 25 with respect to the progress of warming-up of the engine E can be regulated by selecting the length of the surrounding wall 4*b* of the accommodation chamber 27 so as to appropriately set the area of the inner surface of the accommodation chamber 27 facing the temperature sensing section 25.

In the bottomed housing 30 of the temperature sensing section 25, the amount of heat received from the cylinder head 4 through the bottom 30*a*' near the center of the cylinder head 4 is the largest, the stationary piston 33 is in abutment against the inner surface of the bottom 30*a*', and the movable cylinder 31 containing the wax 35 advances in the housing 30 in the direction F to move away from the bottom 30*a*' in response to the thermal expansion of the wax 35. Therefore, the heat received from the housing 30 by the wax 35 in the movable cylinder 31 is large immediately after the start of engine E warming-up operation, and is decreasing with the progress of the warming-up operation.

Particularly, the housing 30 includes: the first portion 30*a* having the bottom 30*a*' and made of a metal having a high heat conductivity; and the second portion 30*b* placed opposite from the bottom 30*a*' and having a high heat insulating property, whereby the above-described tendency of the heat receiving characteristic of the wax 35 can be further improved. That is, when the movable cylinder 31 advances, a portion of the movable cylinder 31 is moved to a position on the side of the second portion 30*b* having a high insulating property, thereby further reducing the amount of heat received by the wax 35. As a result, immediately after the start of the engine E warming-up operation, the wax 35 in the movable cylinder 31 starts expanding by rapidly receiving heat from the first portion of the housing 30, to facilitate the opening of the choke valve 19, thus effectively suppressing an excessively large concentration of fuel in the air-fuel mixture. Also, the movable cylinder 31 is moved from the first portion 30*a* toward the second portion 30*b* in the housing 30 with the progress of warming-up operation, thereby effectively reducing the amount of heat received from the housing 30 by the wax 35 in the movable cylinder 31 with the progress of warming-up operation. Thus, it is possible to appropriately reduce the choke valve 19 opening rate as approaching the completion of warming-up operation, thereby stably continuing the warming-up operation. The amount of heat received by the wax 35 is further reduced after the completion of warming-up operation, thus further contributing to prevention of an excess thermal degradation of the wax 35.

The housing 30 includes the first portion 30*a* having a high heat conductivity, and the second portion 30*b* connected to the first portion 30*a* on the side opposite from the bottom 30*a*' and having a high heat insulating property. Therefore, the heat generated in the engine E is transmitted to the wax 35 in the movable cylinder 31 mainly through the first portion 30*a*. Thus, the characteristics of the temperature sensing section 25 can changed by selecting the shape and position of the first portion 30*a* only, whereby the choke system is applicable to various types of engine E.

Moreover, since the second portion 30*b* having a high heat insulating property and the bracket 10*a* of the output section 26 pivotally supporting the first lever 41 are formed integrally with the heat insulating member 10 interposed between the cylinder head 4 and the carburetor C, the housing 30 of the temperature sensing section 25 and the bracket a can be supported on the cylinder head 4 without using any special supporting member. Thus, it is possible to reduce the number of components to simplify the structure and contributing to a reduction in cost of the automatic choke system A.

The present invention is not limited to the above-described embodiment, and various changes in the design can be made without departing from the subject matter thereof. For example, the movable cylinder 31 is maintained, as a stationary cylinder, in contact with the bottom 30*a*' of the first portion 30*a* of the housing 30; and the stationary piston 33 is connected, as a movable piston, to the retainer 37 or the rod 43 to advance the piston 33 when thermal expansion of the wax 35 is caused.

What is claimed is:

1. An automatic choke system for a carburetor, comprising:

a wax-type temperature sensing section attached to an engine; and an output section providing a connection between the temperature sensing section and a choke valve of the carburetor, and operated to open the choke valve in response to heat receiving operation of the temperature sensing section, wherein the temperature sensing section includes:

a bottomed cylindrical housing attached to the engine with its bottom portion directed to a high-temperature portion of the engine;

a bottomed movable cylinder;

a stationary piston slidably supported in the movable cylinder and having one end protruding out of the movable cylinder;

a wax contained in the movable cylinder in a sealed manner, and causing the movable cylinder and the stationary piston to move relative to each other in an axial direction; and a return spring urging the movable cylinder and the stationary piston in a direction to compress the wax, the movable cylinder being slidably housed in the housing in a state in which an outer end of the stationary piston abuts against an inner surface of the bottom portion of the housing, the output section being connected to the movable cylinder.

2. An automatic choke system for a carburetor, comprising:

a wax-type temperature sensing section attached to an engine; and an output section providing a connection between the temperature sensing section and a choke valve of the carburetor, and operated to open the choke valve in response to heat receiving operation of the temperature sensing section, wherein the temperature sensing section includes:

a bottomed cylindrical housing attached to the engine;

a bottomed movable cylinder;

a stationary piston slidably supported in the movable cylinder and having one end protruding out of the movable cylinder;

a wax contained in the movable cylinder in a sealed manner, and causing the movable cylinder and the stationary piston to move relative to each other in an axial direction; and a return spring urging the movable cylinder and the stationary piston in a direction to compress the wax, the movable cylinder being slidably housed in the housing in a state in which an outer end of the stationary piston abuts against an inner surface of a bottom portion of the housing, the output section being connected to the movable cylinder, the housing is constructed so that an amount of heat received by the wax is decreasing as the movable cylinder moves in a detection away from the bottom portion of the housing.

3. An automatic choke system for a carburetor according to claim 2, wherein the housing comprises a cup-shaped first portion having a high heat conductivity and including the bottom portion, and a cylindrical second portion having a heat insulating property and connected to an open end of the first portion, and the movable cylinder moves from a side of the first portion to a side of the second portion in response to thermal expansion of the wax.

4. An automatic choke system for a carburetor according to claim 1 or 2, wherein the housing comprises a first portion having a heat conductivity and including the bottom portion, and a second portion having a heat insulating property and connected to the first portion on a side opposite from the bottom portion; and wherein the second portion is molded integrally with a heat-insulating member interposed between the engine and the carburetor.

5. An automatic choke system for a carburetor according to claim 4, wherein a bracket for supporting the output section is molded integrally with the heat-insulating member.

6. An automatic choke system for a carburetor according to claim 1 or 2, wherein the temperature sensing section is disposed in the vicinity of an intake port formed in a cylinder head of the engine.

7. An automatic choke system for a carburetor according to claim 6, wherein an accommodation chamber is formed by a peripheral wall of the intake port and a surrounding wall rising from one side of the peripheral wall, and the temperature sensing section is disposed in the accommodation chamber.

8. An automatic choke system for a carburetor according to claim 1 or 2, wherein the output section comprises: a first lever and a second lever which are pivotally supported via a common axis in the bracket supported on the engine, the first lever being operated in response to the heat receiving operation of the temperature sensing section, the second lever being operated in association with the choke valve; abutting portions provided in the first and second levers so as to abut against each other while the abutting portions can move toward and away from each other; a connection spring connected to the abutting portions so that the abutting portions move in a direction to abut against each other; and wherein, before the choke valve is fully opened, the heat receiving operation of the temperature sensing section is transmitted from the first lever through the connection spring to the second lever in a direction to open the choke valve, and after the choke valve is fully opened, only the first lever is turned by the heat receiving operation of the temperature sensing section so that the abutting portions move away from each other against a set load of the connection spring.

9. An automatic choke system for a carburetor according to claim 1 or 2, wherein a governor device is connected to a throttle valve of the carburetor so as to control the throttle valve to open when the engine is stopped and to close to a predetermined opening degree corresponding to a set rotational speed of the engine when the engine is running; and wherein a choke forcibly-opening means is provided between the throttle valve and the choke valve to forcibly open the choke valve in association with the throttle valve closing from a fully opened position to an idling opening position.

10. An automatic choke system for a carburetor according to claim 9, wherein the output section and the choke forcibly-opening means are arranged so that the opening of the choke valve by one of the output section and the choke forcibly-opening means is not impeded by the other.

* * * * *